US005807158A

United States Patent [19]

Tsai

[11] Patent Number: 5,807,158

[45] Date of Patent: Sep. 15, 1998

[54] TOY CAR STRUCTURE WITH VARIOUS COMBINED OPERATIONS

[76] Inventor: Wen-Ho Tsai, 8F, No.113, Yu Jen Rd., Taipei, Taiwan

[21] Appl. No.: 872,168

[22] Filed: Jun. 10, 1997

[51] Int. Cl.[6] ..... A63H 17/25

[52] U.S. Cl. ..... 446/470; 446/288; 446/465

[58] Field of Search ..... 446/470, 288, 446/465

[56] References Cited

U.S. PATENT DOCUMENTS 5,069,649 12/1991 Wu ..... 446/470 X 5,360,367 11/1994 Ho ..... 446/470

*Primary Examiner*—Robert A. Hafer

*Assistant Examiner*—Jeffrey D. Carlson

*Attorney, Agent, or Firm*—Bacon & Thomas

[57] ABSTRACT

A toy car structure with various combined operations, including a housing defining an internal chamber and a driving system disposed in the chamber. The driving system including a transmission wheel and a driven wheel driven by a power source. A disc member is coaxially disposed with the driven wheel and rotatable along with the driven wheel. The disc member has an upper and a lower layers respectively disposed with a shifting section and a shifting pin for pushing a cantilever and a trigger. The cantilever and the trigger further respectively drive a retaining member and a slide board to move from a first position toward a second positions so as to create various combined operations.

6 Claims, 4 Drawing Sheets

TOY CAR STRUCTURE WITH VARIOUS COMBINED OPERATIONS

BACKGROUND OF THE INVENTION

The present invention relates to a toy car structure, and more particularly to an electric toy car structure with various combined operations.

A conventional electric toy car is often able to turn during running. Also, such toy car can emit sound and light to achieve entertaining effect. These operations are basically monotonous and can hardly satisfy the requirements of a child.

SUMMARY OF THE INVENTION

It is therefore a primary object of the present invention to provide a toy car structure with various combined operations, in which a doll with a gun can push open a car door to shoot and a toy helicopter hidden in the toy car can push open a cabinet cover to move upward or downward with the propeller rotating.

According to the above object, the toy car structure includes a housing defining an internal chamber and a driving system disposed in the chamber. The driving system including a transmission wheel and a driven wheel driven by a power source. A disc member is coaxially disposed with the driven wheel and rotatable along with the driven wheel. The disc member is disposed with a shifting section and a shifting pin for pushing a cantilever and a trigger to move between first and second positions.

A projection is disposed on one side of the housing and formed with a fissure for receiving one end of a slide boare, whereby when the trigger moves toward the second Position, the slide board is pushed away from the housing.

The cantilever is pushed by the disc member to linearly move between the first and second positions. The cantilever is formed with a lateral slope wall and connected with a spring at one end. The spring serves to keep the cantilever normally positioned at the first position. When the shifting section of the disc member drives the cantilever to move to the second position, the slope wall forces a retaining member to move along a longitudinal axis.

The present invention can be best understood through the following description and accompanying drawings, wherein:

DETAILED DESCRIPTION OF THE PREFERRED EMBODIMENT

Figure 1:
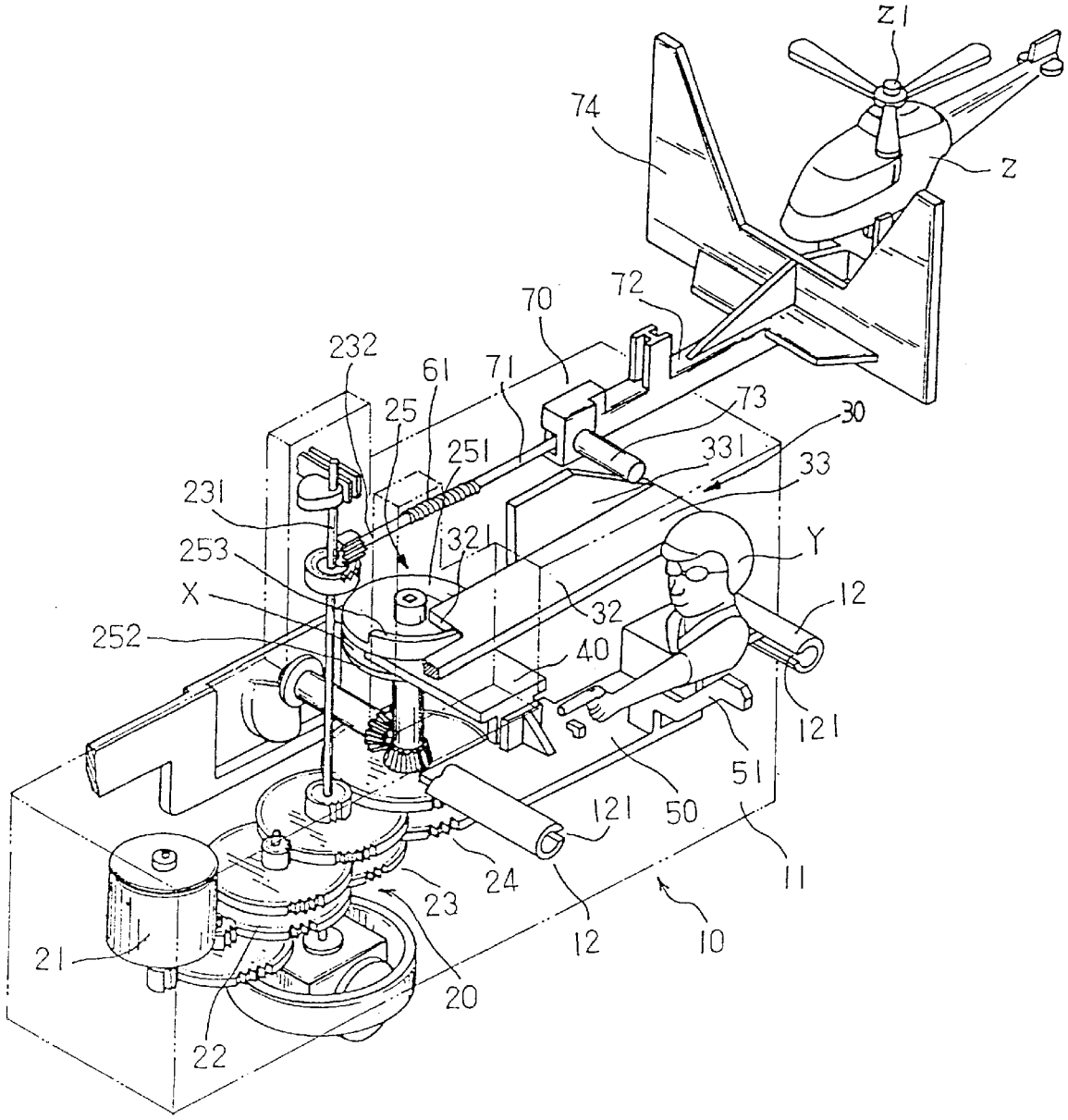
FIG. 1 is a perspective view of the present invention.

Please refer to FIG. 1. The present invention includes a housing 10 defining an internal chamber and a driving system 20 disposed in the chamber. The driving system 20 includes a gear set 22 driven by a power source 21, a transmission wheel 23 and a driven wheel driven by the gear set 22. According to a preferred embodiment, a disc member

Figure 2:
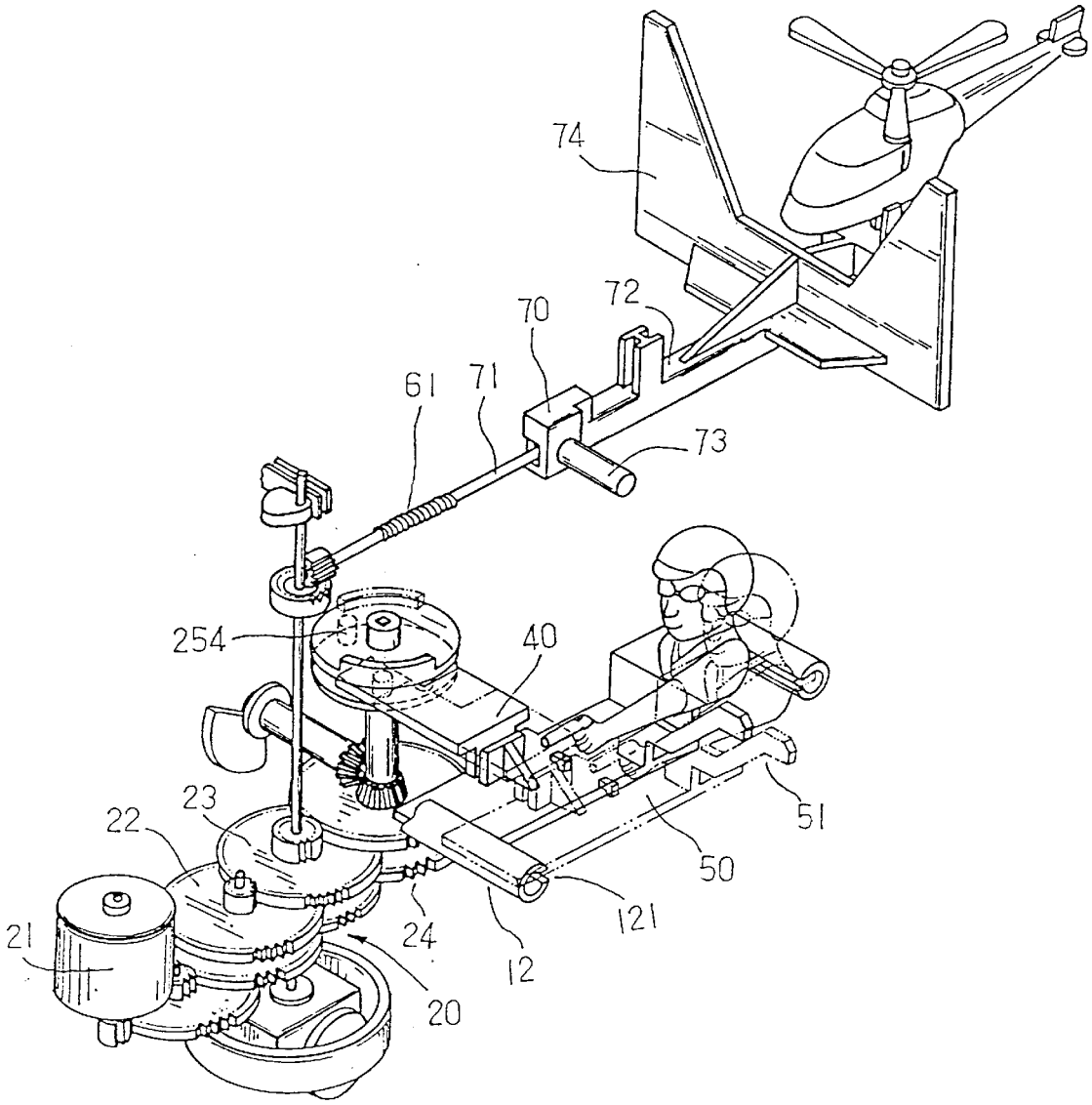
FIG. 2 shows the operation of the driving system of the present invention in one state, wherein the slide board is pushed by the trigger.

25 is coaxially disposed with the driven wheel 24 and rotatable along with the driven wheel 24. The disc member 25 has multiple layers. The circumference of the upper layer 251 of the disc member 25 is formed with a shifting section 253 having a length about one fourth of a circle. A shifting pin 254 ( as shown in FIG. 2 ) is disposed on a lower layer 252 for respectively pushing a cantilever 30 and a trigger 40 between a first and a second positions.

The trigger 40 is disposed in a space X between the upper and lower layers 251, 252. When the disc member 25 rotates, the shifting pin 254 will push the trigger 40 to drive a slide board 50 disposed with a gun-holding doll Y. The slide board 50 has a branch arm 51 and two edges respectively mounted on two projections 12 perpendicularly projecting from the side walls 11 of the housing. Each projection 12 is formed with an axial fissure 121 for slidably receiving one end of the slide board 50. A spring ( not shown ) is disposed under the slide board 50, two ends of which are respectively fixed on the side wall 11 and the bottom of the slide board for keeping the slide board 50 normally positioned at the first position unless the slide board 40 is pushed by the trigger 40.

Figure 3:
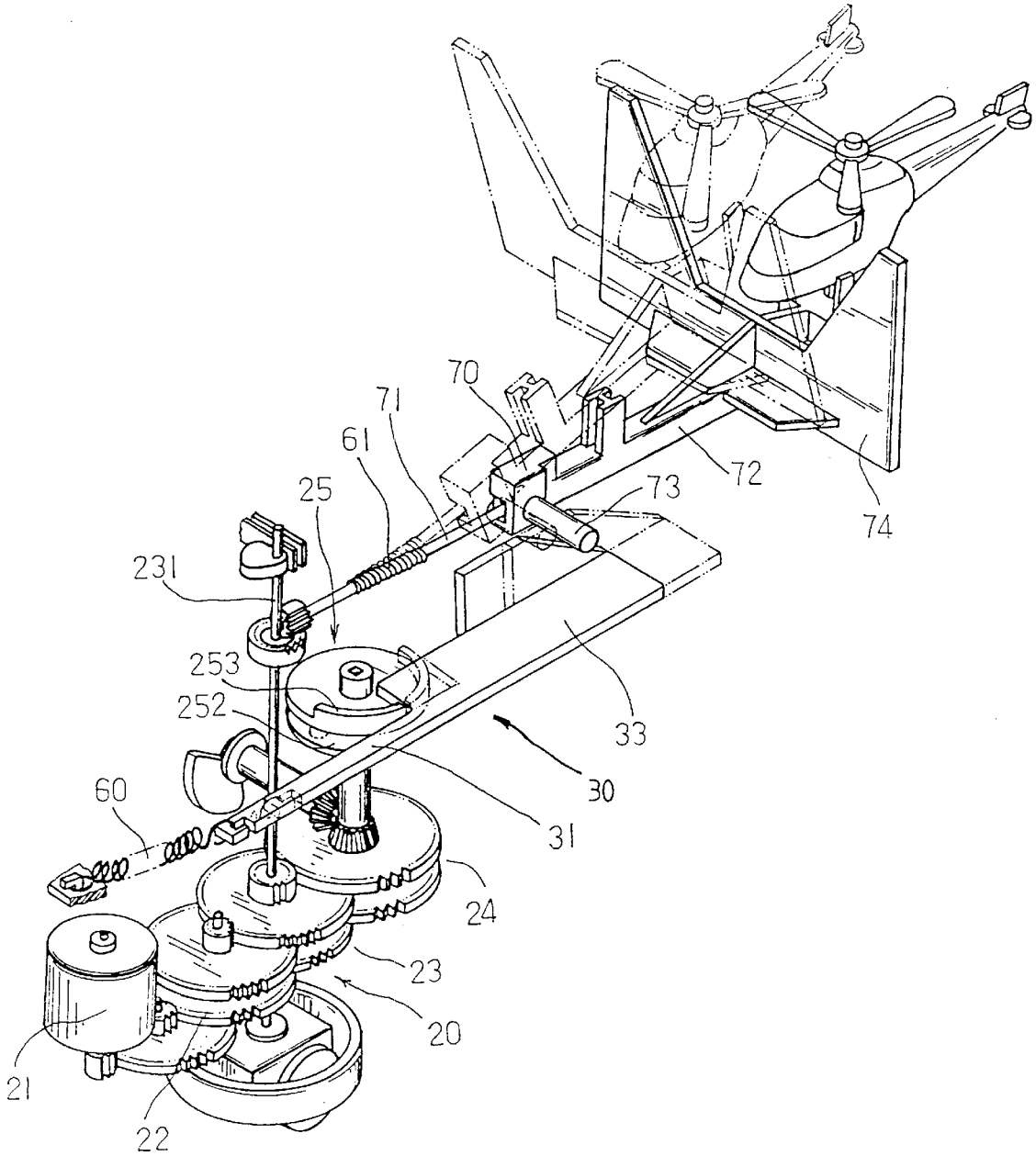
FIG. 3 shows the operation of the driving system of the present invention in another state, wherein the retaining member is driven by the cantilever.

The cantilever 30 has a first end 31 ( as shown in FIG. 3) connected with a spring 60. The cantilever 30 further includes a middle section 32 formed with a notch 321 and a lateral slope wall 331 at a second end 33. The abdomen section 32 rides over the upper layer 251 of the disc member 25, whereby when the disc member 25 rotates, the shifting section 253 can push the cantilever 30 at the notch 321.

Figure 4:
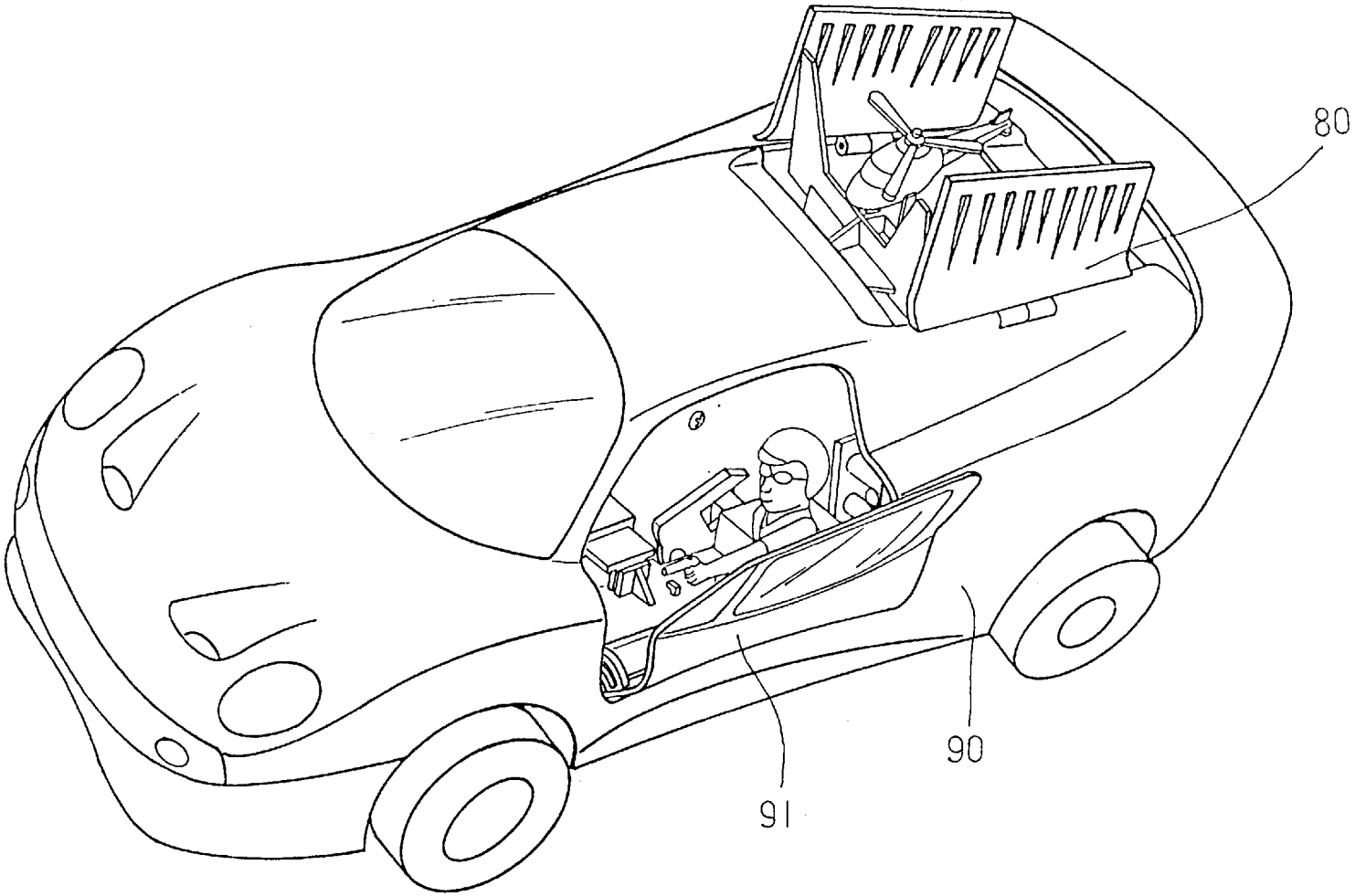
FIG. 4 shows that the present invention is assembled with a toy car body.

A retaining member 70 is disposed with a driven rod 71. The front end of the driven rod 71 is via a coil spring 61 connected with a transmission shaft 232 driven by a core shaft 231 of the transmission wheel 23. The other end of the driven rod 71 extends into a casing 72 of the retaining member 70 to connect with a propeller support Z1 of a helicopter model Z at rear end of the casing 72. The casing 72 includes a transversely projecting pin member 73 supported on the slope wall 331 of the cantilever 30. The rear section of the casing 72 is disposed with a pair of fins 74 perpendicular to the axis of the casing for pushing open a cabinet cover 80 as shown in FIG. 4.

Referring to FIGS. 2 and 3, after the gear set 22 is driven by the power source 21, the driven wheel 24 will drive the disc member 25 to rotate. Accordingly, the shifting pin 254 and the shifting section 253 respectively push the trigger 40 and the cantilever 30 toward the second position to force the slide board 50 to slide outward along the fissure 121 of the projection. At this time, during the operation of the slope wall 331 of the cantilever 30, the pin member 73 of the retaining member 70 is forced to move upward along the slope wall 331. As a result, the casing 72, the fins 74 and the helicopter model Z are lifted as shown by the phantom line of FIGS. 2 and 3. In a preferred embodiment, the housing 10 and the driving system 20 are installed in an electric car model 90 as shown in FIG. 4. The car model 90 is disposed with a movable car door 91 and a movable cabinet cover 80. When moving to the second position, the branch arm 51 of the slide board 50 and the fins 74 of the retaining member 70 will respectively push open the car door 91 and the cabinet cover 80, making the doll Y slide to outer side of the car model 90 and making the helicopter model Z move upward until the shifting pin 254 and the shifting section 253 leave the trigger 40 and the notch 321 due to continuous rotation of the disc member 25. At this time, the slide board 50 and the cantilever 30 are pulled back to the first position by the spring 60.

When the shifting pin 254 and the shifting section 253 are again rotated to the original operation position, the above procedure is repeated to create various combined operations.

According to the above arrangement, the core shaft 231 of the transmission wheel 23 is drivingly connected with the transmission shaft 232, whereby the driven rod 71 is able to transmit the power to the support Z1, making the propeller rotate when the fins 74 push open the cabinet cover 80. The coil spring 61 can be curved, permitting the retaining member 70 to move upward and downward without affecting the operation. Preferably, the cantilever 30 is parallel to the retaining member 70. This helps in keeping them moving between the first and second positions along the same longitudinal axis to minimize the left or right deflection of the cantilever 30 and the retaining member 70. In comparison with that the disc member 25 directly pushes the retaining member 70, a higher stability of operation is achieved.

It should be noted that the above description and accompanying drawings are only used to illustrate one embodiment of the present invention, not intended to limit the scope thereof. Any modification of the embodiment should fall within the scope of the present invention.

What is claimed is:

1. A toy car structure with various combined operations, comprising a housing defining an internal chamber and a driving system disposed in the internal chamber, the driving system including a transmission wheel and a driven wheel driven by a power source, a slide board, a cantilever and a retaining member, and further comprising a disc member coaxially disposed with the driven wheel and rotatable along with the driven wheel, the disc member having upper and lower layers defining a space therebetween, a trigger disposed in the space between the upper and lower layers for pushing the slide board, the cantilever having a first end, a second end formed with a lateral slope wall, and a middle section, a circumference of the upper layer of the disc member having a shifting section, a shifting pin disposed on the lower layer of the disc member, whereby when the disc member is rotated, the shifting section and shifting pin respectively push the cantilever and the trigger between first and second positions.

2. A toy car structure as claimed in claim 1, wherein the middle section of the cantilever has a notch positioned on a rotating path of the shifting section.

3. A toy car structure as claimed in claim 1, wherein the slide board has a branch arm.

4. A toy car structure as claimed in claim 1, wherein the first end of the cantilever is connected to a spring.

5. A toy car structure as claimed in claim 1, wherein the shifting section has a length approximately one fourth of a circle.

6. A toy car structure as claimed in claim 1, wherein the cantilever is parallel to a longitudinal axis of the retaining member with the lateral slope wall supporting a pin member of the retaining member.

* * * * *